US005302826A

United States Patent [19]

Wells

[11] Patent Number: 5,302,826

[45] Date of Patent: Apr. 12, 1994

[54] QUADRUPOLE TRAP IMPROVED TECHNIQUE FOR COLLISIONAL INDUCED DISASSOCIATION FOR MS/MS PROCESSES

[75] Inventor: Gregory J. Wells, Fairfield, Calif.

[73] Assignee: Varian Associates, Inc., Palo Alto, Calif.

[21] Appl. No.: 890,996

[22] Filed: May 29, 1992

[51] Int. Cl.[5] ..... H01J 49/42

[52] U.S. Cl. ..... 250/292; 250/282

[58] Field of Search ..... 250/292, 291, 281, 282

[56] References Cited

U.S. PATENT DOCUMENTS 4,736,101 4/1988 Syka ..... 250/292

OTHER PUBLICATIONS

Yates, N. A. et al. "Resonant Excitation for GC/MS/MS in the Quadrupole Ion Trap via Frequency Assignment Pre-Scans and Broadband Excitation," 39th ASMS Conference on "Mass Spectroscopy and Allied Topics", May 1991, pp. 132–133.

March, Raymond E. et al. *Quadrupole Storage MassSpectrometry, 1989, John Wiley & Sons.*

*Primary Examiner*—Jack I. Berman

*Attorney, Agent, or Firm*—Gerald M. Fisher

[57] ABSTRACT

Method and apparatus for inducing collisional disassociation of isolated ions in a QIT which employs low frequency modulation of the secular frequency of oscillation of the trapped ions so as to permit sufficient frequency coincidence with the fixed frequency tickle generator to induce collisional disassociation.

12 Claims, 6 Drawing Sheets

QUADRUPOLE TRAP IMPROVED TECHNIQUE FOR COLLISIONAL INDUCED DISASSOCIATION FOR MS/MS PROCESSES

FIELD OF THE INVENTION

This invention relates to an improved method and apparatus for collisionally inducing disassociation of ions in a quadrupole ion trap.

RELATED APPLICATION

The following copending, simultaneously filed invention by the same inventor related to this invention and is incorporated herein by reference: "Quadrupole Trap Improved Technique of Ion Isolation" by Greg Wells, Ser. No. 890,990, filed May 29, 1992, now U.S. Pat. No. 5,198,665.

BACKGROUND OF THE INVENTION

The quadrupole ion trap (QIT) was first disclosed in the year 1952 in a paper by Paul, et al. This paper disclosed the QIT and the disclosure of a slightly different device which was called a quadrupole mass spectrometer (QMS). The quadrupole mass spectrometer was very different from all earlier mass spectrometers because it did not require the use of a magnet and because it employed radio frequency fields for enabling the separation of ions, i.e. performing mass analysis. Mass spectrometers are devices for making precise determination of the constituents of a material by providing separations of all the different masses in a sample according to their mass to charge ratio. The material to be analyzed is first disassociated/fragmented into ions which are charged atoms or molecularly bound group of atoms.

The principle of the quadrupole mass spectrometer (QMS) relies on that fact that within a specifically shaped structure, radio frequency (RF) fields can be made to interact with a charged ion so that the resultant force on certain of the ions is a restoring force thereby causing those particles to oscillate about some referenced position. In the quadrupole mass spectrometer, four long parallel electrodes, each having highly a precise hyperbolic cross sections, are connected together electrically. Both dc voltage, U, and RF voltage, $V_0 \cos \omega t$, can be applied. When an ion is introduced or generated within the spectrometer, if the parameters of the quadrupole are appropriate to maintain the oscillation of those ions, such ions would travel with a constant velocity down the central axis of the electrodes at a constant velocity. Parameters of operation could be adjusted so that ions of selected mass to charge ratio, m/e, could be made to remain stable in the direction of travel while all other ions would be ejected from the axis. This QMS was capable of maintaining restoration forces in two directions only, so it became known as a transmission mass filter. The other device described in the above mentioned Paul, et al. paper has become known as the quadrupole ion trap (QIT). The QIT is capable of providing restoring forces on selected ions in all three directions. This is the reason that it is called a trap. Ions so trapped can be retained for relatively long periods of time which supports separation of masses and enables various important scientific experiments and industrial testing which can not be as conveniently accomplished in other spectrometers.

The QIT was only of laboratory interest until recent years when relatively convenient techniques evolved for use of the QIT in a mass spectrometer application. Specifically, methods are now known for ionizing an unknown sample after the sample was introduced into the QIT (usually by electron bombardment), and adjusting the QIT parameters so that it stores only a selectable range of ions from the sample within the QIT. Then, by linearly changing, i.e., scanning, one of the QIT parameters it became possible to cause consecutive values of m/e of the stored ions to become successively unstable. The final step in a mass spectrometer was to sequentially pass the separated ions which had become unstable into a detector. The detected ion current signal intensity, as a function of the scan parameter, is the mass spectrum of the trapped ions.

U.S. Pat. No. 4,736,101 describes a quadrupole technique for performing an experiment called MS/MS. In U.S. Ser. No. 4,736,101, MS/MS is described as the steps of forming and storing ions having a range of masses in an ion trap, mass selecting among them to select an ion of particular mass to be studied (parent ion), disassociating the parent ion by collisions, and analyzing, i.e. separating and ejecting the fragments (daughter ions) to obtain a mass spectrum of the daughter ions.

In a copending, simultaneously filed patent application, I have disclosed and claimed an improved QIT technique for isolating the parent ion. For purposes of understanding the background for this invention, I have incorporated by reference, the copending application entitled, "Quadrupole Trap Improved Technique of Ion Isolation," Ser. No. 890,990, filed May 29, 1992, now U.S. Pat. No. 5,198,665.

The preferred technique for disassociating the parent ion into daughter ion fragments is called Collision Induced Disassociation (CID). The CID technique is a more gentle form of ionization than electron bombardment and does not create as many fragments. The technique for obtaining collision induced disassociation (CID) to obtain daughter ions employed in U.S. Pat. No. 4,736,101 is to use a second fixed frequency generator connected to the end plates of the QIT which frequency is at the calculated secular frequency of the retained ion being investigated. The secular frequency is the frequency at which the ion is periodically, physically, moving within the RF trapping field.

By providing an excitation field at the secular frequency, the ion absorbs power and the increased translational motion causes more collisions between ions. The collisions induce conversion of translational energy into internal energy and result in a somewhat gentle fragmentation of the ion into major daughter fragments. This is most frequently carried out in the presence of a background gas of lighter mass than the sample to aid in the collision heating process.

The problem with the prior approach of the '101 patent for causing such collisional assisted ionization (CAI) is that the frequency of the supplemental end cap voltage, sometimes called the tickle voltage, cannot be properly determined in advance. Theoretically, the secular frequency of any selected M/e ion is relatively easy to calculate according to the equation $W_1 = \frac{1}{2}\beta_z W_0$, where $W_1$ equals the secular frequency, $W_0$ is the trapping field frequency and $\beta_z$ is a known function of $q_z$ and $a_z$, as defined by three different equations, depending on the value of $q_z$, as depicted at page 200 of the text "Quadrupole Storage Mass Spectrometry" by Raymond E. March and Richard J. Hughes, John Wiley & Sons, 1989. However, there are several physical effects which affect the QIT and render it extremely difficult, if not impossible, to determine the precise secular frequency in advance. Specifically, the space charge effect, which depends on the number of trapped ions will shift the stability chart for the trap. Also, slight mechanical errors in the shape of the electrodes and slight variances in the potentials applied to the electrodes can introduce errors which shifts the secular frequency from theoretical values.

Accordingly, it has been necessary to empirically determine the secular resonance frequency for each M/e to be excited. While this step of establishing the specific resonant frequency is possible for known static samples, it can be extremely difficult to accomplish when only small values of sample are available on a dynamic basis, such as is the situation when the sample is the output from a gas chromatograph.

This problem has been previously recognized by Yates and Yost in an article presented during May 1991 and published in the proceeding of the 39th MAS Conference on "Mass Spectroscopy and Allied Topics", entitled, *Resonant Excitation for GS/MS/MS in the Quadrupole Ion Trap via Frequency Assignment Prescans and Broadband Excitation*," p. 132.

Yates, et al., describes a complex technique for determining the exact secular frequency for CID in an MS/MS experiment involving automatic scanning of the trap with a frequency synthesizer and measuring the absorption as a function of frequency. Since some of the ions are ejected for each scan due to energy absorption, the space charge effects change and it is necessary to employ multiple scans and averaging to correct for this and other instrumental effects. Yates discloses another technique for inducing CID by using a supplemental broadband excitation signal to excite a range of frequencies. The approach in the Yates paper uses an excitation signal that has a bandwidth of approximately 10 KHz. The broadband excitation technique was orally described in the conference, as the application of a synthesized inverse FT time domain waveform to the QIT end caps, where the waveform has a frequency domain representation comprising a band of uniform intensity equally spaced frequencies up to ±5 KHz about a center frequency at the calculated theoretical secular frequency.

The problems with this broadband technique is that it has a range of excitation which is wide enough to induce excitation of m(p)+1 ions and of daughter ions that may be formed during the excitation process. Furthermore, the apparatus needed to obtain a tailored, synthesized broad band inverse waveform is expensive and complex.

SUMMARY OF THE INVENTION

It is an object of this invention to provide a simple but effective method and apparatus for obtaining collisional disassociation of isolated ions in an MS/MS experiment.

It is a still further object to provide broadband excitation apparatus and technique which is useful in connection with a QIT and which apparatus does not require a frequency to time domain synthesizer.

It is a further object of this invention to eliminate the requirement to provide an oscillator having a frequency which precisely matches the secular frequency of an ion in order to excite the ion for CID;

An aspect of this invention is to enable use of a single AC frequency for modulating the trapping field of a QIT for coupling energy into a trapped ion in said QIT.

BRIEF DESCRIPTION OF THE INVENTION

FIG. 5A, 5B, 5C, and 5D are MS/MS spectra for PFIBA for isolated M/e=131 with the application of the RF modulation of this invention for different supplemental frequencies overlapping the secular frequency for M/e=131.

Figure 6:
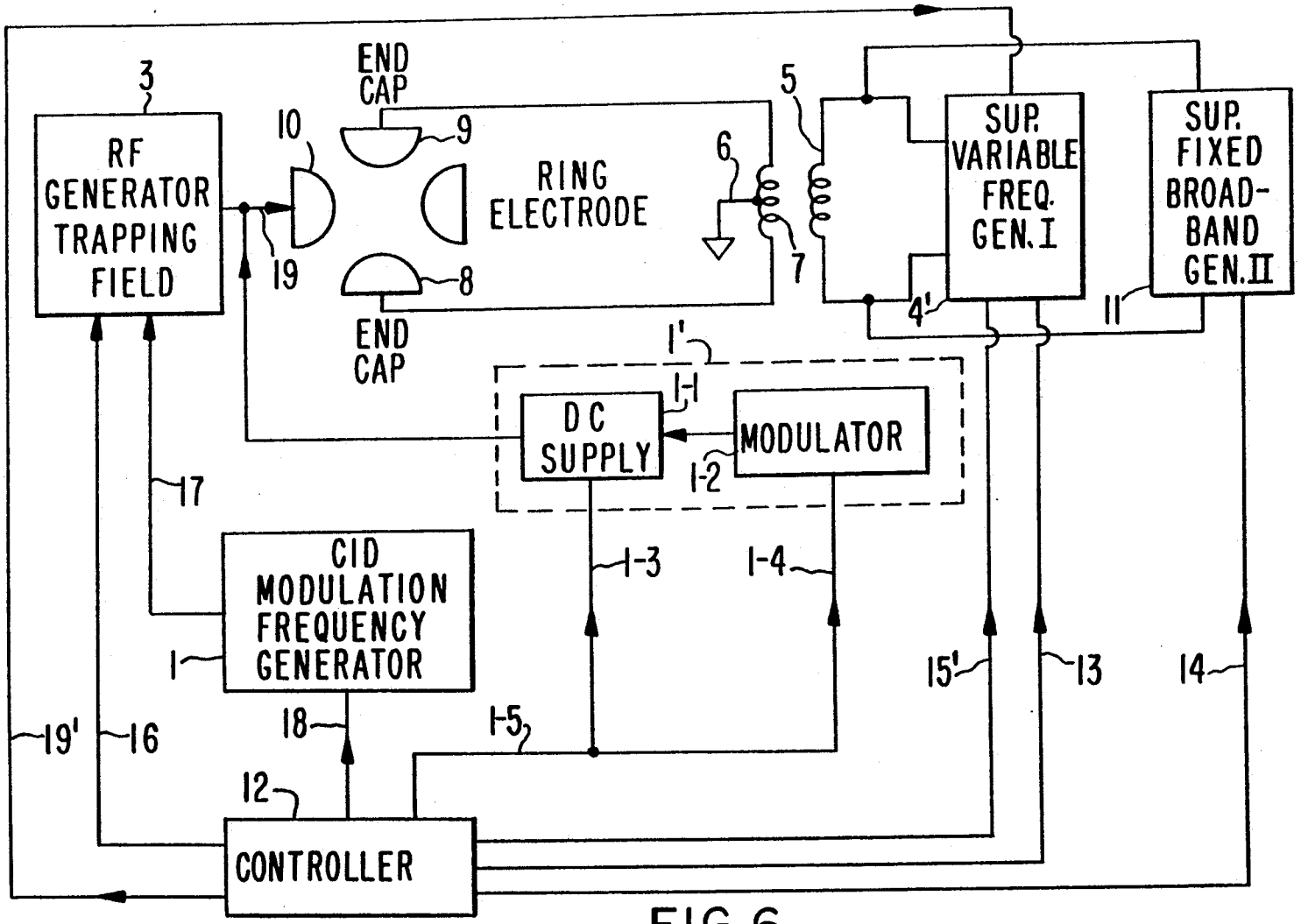

FIG. 6 is a block diagram of an alternate embodiment of my invention.

DETAILED DESCRIPTION OF THE INVENTION

Figure 1:
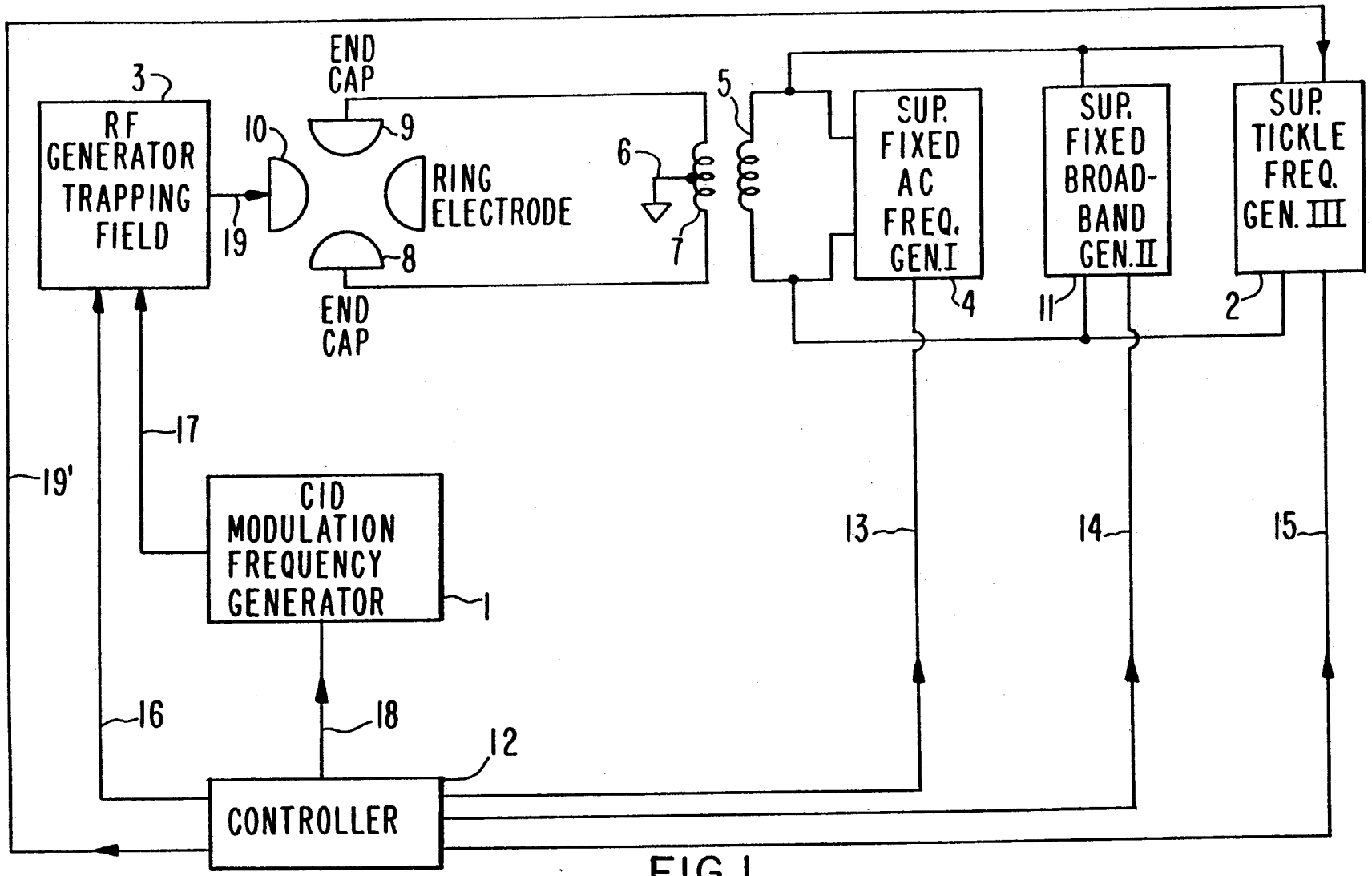
FIG. 1 is a block diagram of my novel QIT spectrometer system.

With reference to FIG. 1, the quadrupole ion trap (QIT) comprised of ring electrode 10 of hyperbolic shape and end cap electrodes 8 and 9, also of hyperbolic shape are shown connected to RF Trapping Field Generator 3 and RF transformer primary winding 7 respectively. In this schematic, the winding 7 has its center tap 6 grounded. The secondary winding 5 of the transformer is connected in parallel to several supplemental field generators. Supplementary Generator I, 4, is a fixed frequency AC generator and Supplemental Generator II, 11 is a Fixed Broadband Spectrum Generator. The RF Trapping Field Generator 3 and Supplemental Generator I and Supplemental Generator II are employed, as explained more fully in the above cited copending related application, to isolate a selected parent ion as part of an MS/MS experiment.

The Supplemental Tickel Frequency Generator III, 2 is also connected in parallel to the secondary transformer winding 5. Supplemental Tickle Frequency Generator III is a variable frequency oscillator. The frequency of Generator III is set as determined by the relationship $W_1=\frac{1}{2}\beta_z W_0$ to match the secular frequency of motion of the selected parent ion.

Supplemental Generator III and CID Modulation Frequency Generator 1 cooperate as part of my inventive scheme for exciting collisions of said parent ion to obtain a spectrum of MS/MS daughter ions. During the period that the Tickle Frequency Generator III is on, the CID Modulation Frequency Generator 1 which is set at approximately 500 Hz is causing the RF Trapping Field Generator output 19 applied to the ring electrodes 10 to be amplitude modulated.

Controller 12, includes a program sequence generator to enable the Supplemental Generators I, II and III via lines 13, 14 and 15 respectively. The controller 12 also provides the scanning voltage control on line 16 for controlling the RF trapping field ramping potential output 19 as a function of time and the frequency control command on line 19' to the Tickle Frequency Generator III.

Figure 3:
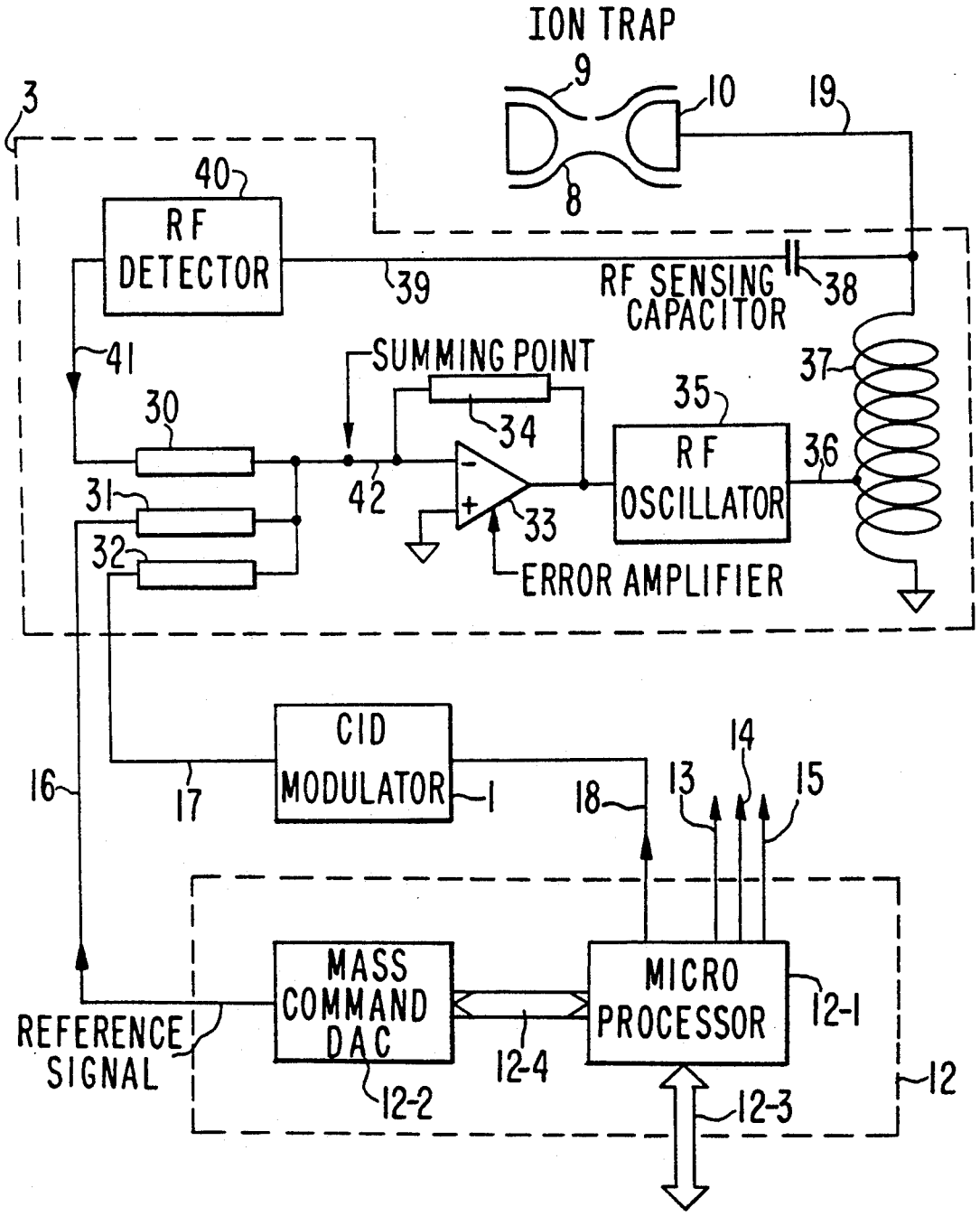
FIG. 3 is a schematic for one embodiment of the control of the RF trapping field generator of my invention.

With reference to FIG. 3, Controller 12, includes a microprocessor 12-1 having buses 12-3 for interfacing to a peripheral or memory for providing programming to the microprocessor. The microprocessor provides timing control outputs 13, 14, 15, and 18 and an internal bus 12-4 to control and provide values to the digital to analogue converter (DAC) 12-2 used to providing the scan control and reference signal 16 to the RF Trapping Field Generator 3 shown within the dashed lines.

The RF Trapping Field Generator 3 includes a summing point 42 which receives signals from CID Modulator 1 through summing element 32 and signal 16 from the Mass Command DAC 12-2 via summing element 31. Also connected to summing point 42 is the feedback signal from the summing element 30 from RF detector 40.

The RF detector 40 is coupled to low pass capacitor 38 for providing via RF detector 40 an opposing dc level to render the input at the summing point 42 to zero. The summing point 42 is connected to a high gain error amplifier 33 with a feed back element 34 to comprise a Miller error amplifier circuit. The output of amplifier 33 is connected to the RF oscillator 35 and controls the peak-to-peak amplitude of the RF output 36 coupled to the ring electrode 10 via transformer 37 and lead 19.

Figure 2:
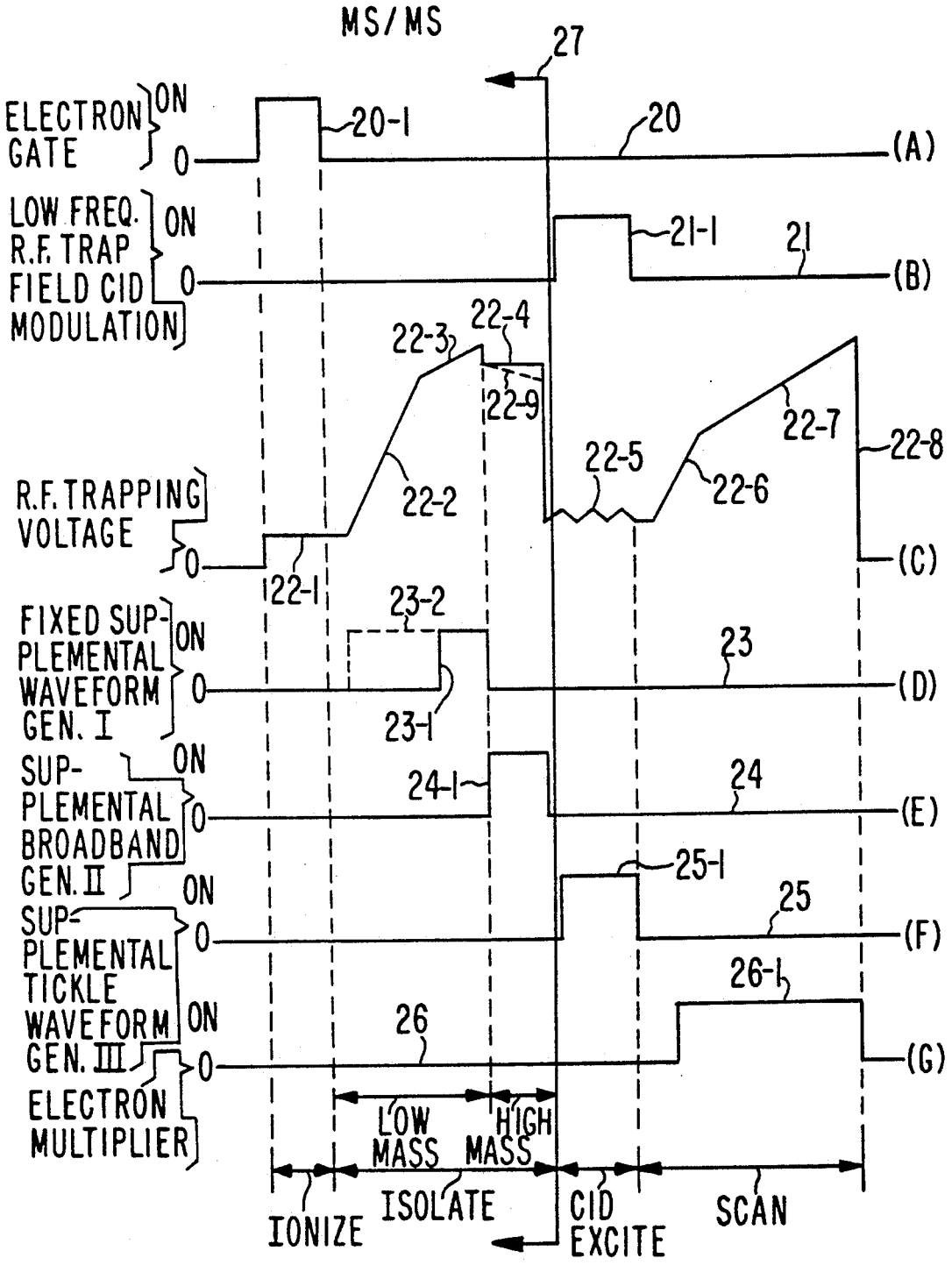
FIG. 2 is a scanning time sequence according to my invention.

With reference to FIG. 2, the sequence employing my invention is more fully explained. The portion of the FIG. 2 timing diagram to the left of the vertical line 27 is related to the technique for isolating a selected parent ion and is not part of this invention. This portion to the left of line 27 is fully explained in the copending Related Application cited above. Specifically, during the period designated "ionize", as shown, the RF Trapping voltage 22-1 is set to a value to store a large range of ions and the electrodes gate 20-1 is enabled permitting a beam of electrons, not shown, to enter into the trap to violently impact the molecules of the sample and cause ionization thereof. Other forms of ionization can also be employed. Next, the RF Trapping voltage is scanned 22-2 and 22-3 by ramping up the voltage. The peak voltage in the upper ramp section 22-3 is selected to eject ions from the trap with masses of M/e values less than a selected parent ion m(p) value, i.e., usually M(p)−1. As explained in my copending related application, it is useful to apply the Supplemental Fixed Frequency I during this same period. It is highly beneficial to apply the Supplemental Fixed Frequency I, 23-1, toward the end of the ramp 22-3, but it is also useful if it is applied during the full ramping time 23-2. After the ramp reaches the programmed value for m(p)−1, the RF Trapping Field is decreased somewhat, 22-4, or preferably as shown by the dashed line 22-9, and the Supplemental Fixed Broadband Generator II output is energized, 24-1. The Supplemental Broadband Generator II waveform is fully described on the copended Related Application described above and comprises a time domain waveform having frequencies in the range 420–460 KHz down to 10–20 KHz, which frequencies, of equal amplitude and random phases, are added together. This excitation will efficiently eject ions greater than m(p) and isolate the selected ion.

My invention is implemented in the portion of the MS/MS sequence which follows. Having isolated the parent ion, m(p), it is now desired to gently cause it to be disassociated into fragments or daughters and to obtain a mass spectrum of the daughter ions.

In the prior art, as explained earlier in the section entitled BACKGROUND OF THE INVENTION, a tickle frequency had been applied to the end caps. The difficulty has been that it was impossible to known in advance the proper tickle frequency for CID. This lead to inconvenience and considerable expense in MS/MS experiments.

We have overcome this problem by providing a low frequency, i.e., 500 Hz modulation, 21-1, to the RF Trapping Field Voltage 22-5 during the time that the Supplemental Tickle Waveform Generator III voltage 25-1 is applied. Our experiments have shown that even though the tickle frequency is not at the precise secular frequency required for excitation of collisional assisted disassociation, because of the modulation of the RF Trapping voltage, sufficient frequency excitation is coincident with the secular frequency to induce CID. Following the CID, the RF Trapping voltage ramping is usually again undertaken 22-6 and 22-7 while the electron multiplier is enabled 26-1 to detect and provide an output which is processed and is representative of the mass spectrum of the daughters of the parent ion. A daughter ion could also be disassociated and granddaughter ions isolated. This is called $(MS)^N$.

The amplitude and frequency of the CID Modulation Frequency Generator 1 needs to be selected so it does not excite the daughter ions and to gently disassociate the parent. In the experimental equipment employed, we have determined that we produce essentially the same efficiency of disassociation as if the tickle frequency was perfectly matched to the secular frequency by doubling the tickle voltage from 0.65 volts to 1.35 volts for a tickle frequency off resonance by ±1.62%.

With reference to FIG. 4A–4C and FIG. 5A–5D, I have shown the results of an experiment to demonstrate the CID effectiveness of my invention. The experiment involves the apparatus of FIG. 1 and relates to performing CID experiments with and without the CID Modulation Frequency Generator 1.

Figure 4A:
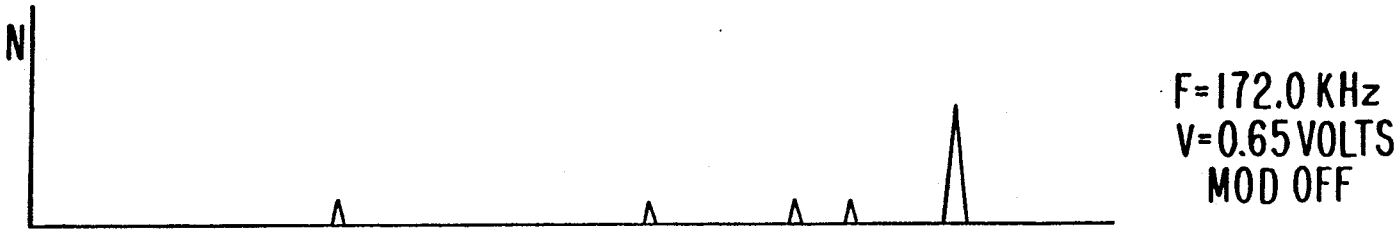
FIG. 4, 4B and 4C are MS/MS mass spectra of PFTBA for isolated M/e=131 for different supplemental frequencies overlapping the secular frequency for M/e=131.
Figure 4B:
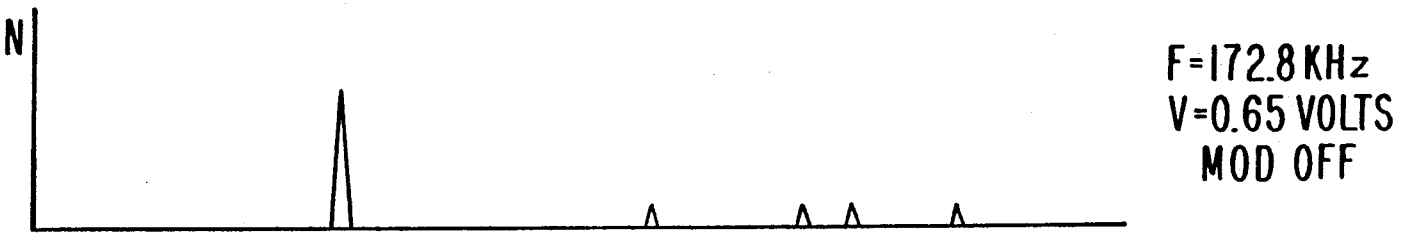
Figure 4C:
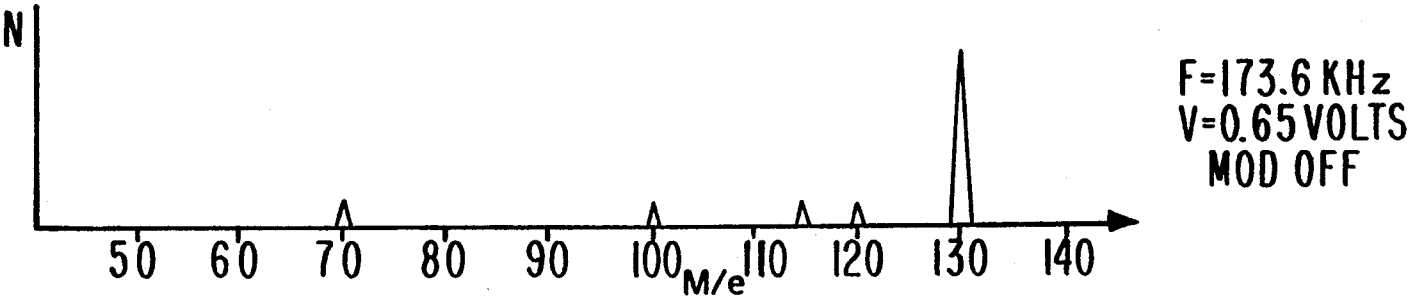
Figures 5A, 5B, 5C, 5D:
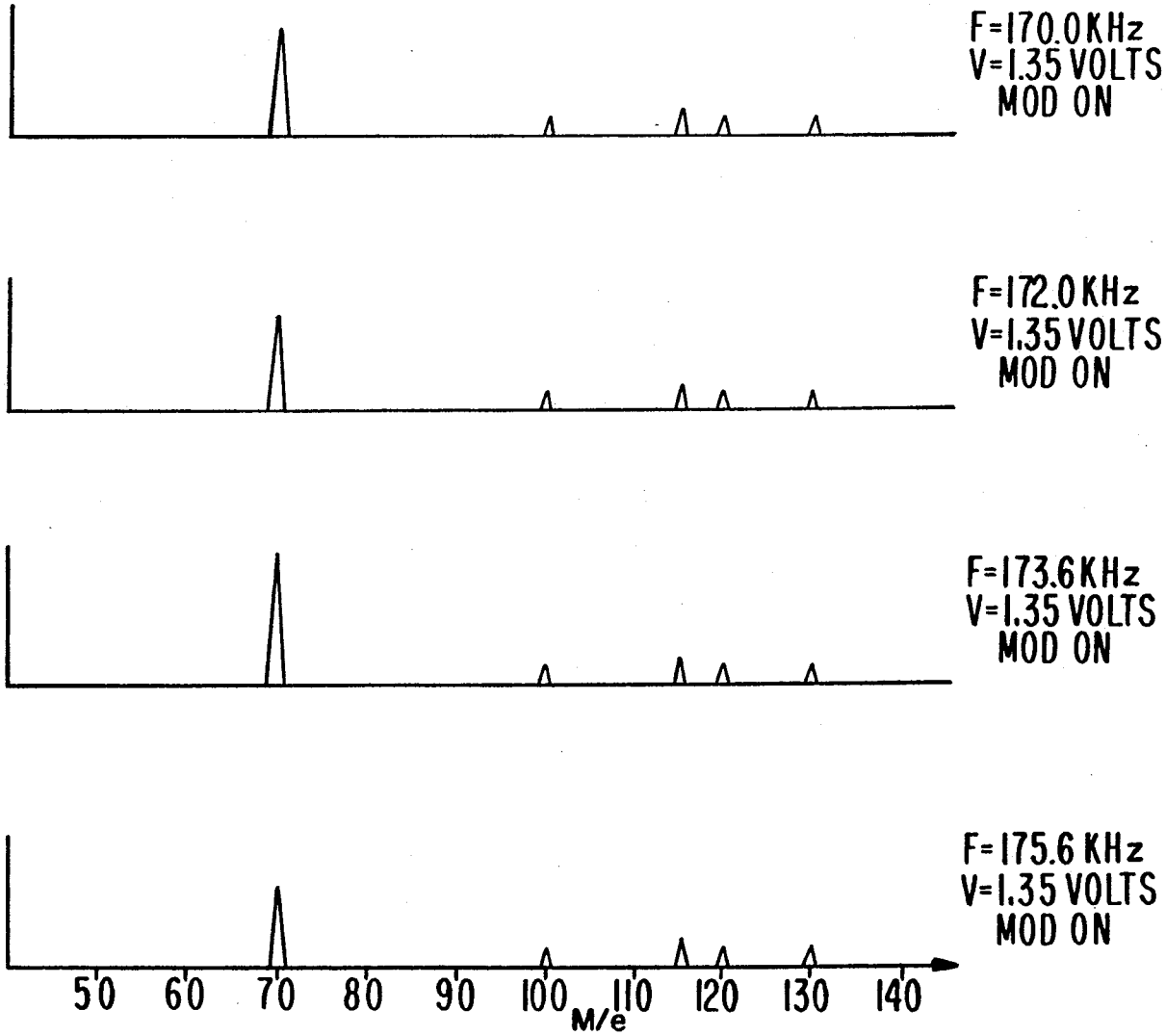

Each spectrum of FIG. 4A–C is the result of exciting an isolated ion of PFTBA m/e=131 and recording the mass spectrum of the daughter ions. The active secular frequency for the M/e 131 ion is F=172.8 KHz for the experimental QIT at the value of RF Trapping Field. The Trapping field is held at a constant value during application of several different tickle frequencies.

In FIG. 4B, when the tickle frequency from Generator III exactly equals the secular frequency, i.e., 172.8 KHz, it is seen that the M/e 131 ion is disassociated almost entirely into the daughter M/e=69 by the loss of the neutral mass 62 ($C_2F_2$). By experimentally running the above experiment repeatedly for tickle frequency in 100 Hz steps from the precise secular frequency, it was determined that F=170 KHz and F=173.6 KHz were on the opposite side of the resonance. It can be seen in FIG. 4A and FIG. 4C that there is no energy disassociation of the M/e=131 ion at those tickle frequencies. The CID Modulation Frequency Generator was turned off during the time the Tickle Generator III was on in each of the experiments of FIG. 4A–4C.

In FIG. 5A–5D, for the same value of RF trapping field, and with a slightly higher value of Tickle Generator III voltage, with the CID Modulation Frequency Generator I in the "on" state at 500 Hz during the tickler "on" state, it is seen that the daughter ion at M/e=69 is efficiently created at essentially uniform intensity even though the tickler frequency Generator III is off resonance up to $W_1 \pm 1.6\%$.

The above experiment shows that when one uses the CID Modulation Generator 1, that the tickle frequency can be calculated according to the equation for the secular frequency $W_1=\frac{1}{2}\beta_z W_0$ without concern for corrections for space charge or electrode machining errors. At 500 Hz on the CID Modulation Frequency Generator, the ions within the range m(p)±2 will be excited and this appears to be adequate to compensate for space charge effects and small mechanical errors. The specific value of $\beta_z$ for the RF field used would still need to be determined by calibration but this curve will remain constant for a reasonably long period so that no other compensation is necessary during one experiment.

With reference to FIG. 6, I show another embodiment of my invention. In view of the fact that Supplemental Generator I and Supplemental Generator III are not enabled at the same time while performing an MS/MS experiment, it is possible for their functions to be combined in one Variable Frequency Generator 4' in FIG. 6. The controller 12 must now provide the enabled signal on line 15' for the CID function and the enabled signal on line 13 for the isolation function. In addition to these enable signals, the controller 12 provides frequency and amplitude control signals on interconnection 19' to command the Supplemental Variable Frequency Generator 4' to the required values. Connector 19' may be a multiple lead bus as required depending on whether the input control circuit on the Supplemental Variable Frequency Generator 4' is designed to received analogue, digital, serial, or parallel control data. In any event, the operation of the apparatus of FIG. 6 is identical to the description with respect to FIG. 1 and FIG. 2 with the Supplemental Variable Frequency Generator 4' providing to signals of FIG. 2(D) and FIG. 2(F).

Although this invention is described with reference to the embodiment of FIG. 1, it could be accomplished in a configuration involving a fixed DC field U, in series with the RF trapping field V. In addition, the Tickle Generator III could be frequency modulated or the CID field modulation could be on while the Tickle Generator is pulsed for a limited period.

In FIG. 6, the alternative modulation generator 1' of the DC voltage U applied to the ring electrode is illustrated. The modulator 1-2 is enabled via connection 1-4 after ion isolation, and it causes modulation of the output voltage of the DC supply 1-1 connected to the ring electrode 10. The secular frequency of oscillation of an ion is a function of $\beta$, and $\beta$ is a function of the parameter "q" and "a". Modulation of the DC voltage U applied to the ring electrode induces a change in the parameter "a" and hence in $\beta$. The modulation frequency should be near 500 Hz for the same reasons as explained with respect to the RF trapping field modulation.

The invention herein has been described with respect to specific figures of this application. It is not my intention to limit the invention to any specific embodiment but the scope of the invention should be determined by the claims. With this in view

What is claimed is:

1. In a method for performing collisionally induced disassociation (CID) of ions in a quadrupole ion trap (QIT) having a ring and end cap electrodes, including the steps of:

(a) applying RF trapping voltages V(t) to said ring electrode at RF frequency $W_0$;

(b) applying supplemental voltages to said end caps;

(c) adjusting said RF trapping voltage level and sequencing said RF trapping voltage and said supplementary voltages to isolate a selected ion in said QIT;

(d) modifying the potential field within said QIT for causing energy absorption of said selected ion and resulting in collisional disassociation of said ion, The Improvement Comprising:

wherein said step of modifying the potential field within said QIT for causing energy absorption of said selected ion and for resulting in collisional disassociation includes modulating one of said voltages so that the potential field periodically has a frequency component which equals the secular frequency of said selected ion.

2. The method of claim 1 wherein the step of modulating one of said voltages includes modulating the amplitude of said RF trapping voltage.

3. The method of claim 2 wherein said amplitude modulation results in a function $G(t)=V(t)J(t)$ where $J(t)=K_1 \cos W_2 t$ and where $K_1$ is a constant and where $W_2 << W_0$ and t=time.

4. The method of claim 3 wherein the step of modulating the amplitude of said RF trapping voltage includes selecting $W_2$ at approximately 500 Hz and $W_0$ at approximately 1.050 MHz.

5. The method of claim 2 wherein the step of modifying the potential field within said QIT includes, energizing a supplemental Tickle Voltage Generator during at least a portion of the period during which modulation of said RF trapping voltage is taking place.

6. The method of claim 1 wherein the said step of modulating said potential field includes modulating the frequency of the said supplemental voltage to said end caps.

7. In a method for performing collisionally induced disassociation (CID) of ions in a quadrupole ion trap (QIT) having ring and end cap electrodes, including the steps of:

(a) applying RF trapping voltages to said ring electrode at frequency $W_0$;

(b) applying supplemental voltages to said end caps;

(c) adjusting said RF trapping voltage and said supplementary voltages and sequencing said RF trapping voltage and said supplementary voltages to isolate a selected ion or range of ions;

(d) applying a supplementary tickle voltage at a selected frequency to excite the selected ion or range of ions to become disassociated by collision;

(e) scanning said RF trapping voltage to, eject daughter ions from said QIT;

The Improvement Comprising:

during said step of applying said supplementary tickle voltage, modulating said RF trapping voltage at a low frequency $W_2$.

8. The method of claim 7 wherein said step of modulating said RF trapping voltage includes the step of amplitude modulation.

9. The method of claim 8 wherein $W_2$ is approximately 500 Hz.

10. In a QIT having;

a ring electrode, said ring electrode substantially enclosing a volume except for top and bottom;

a pair of end cap electrodes, said end cap electrodes substantially enclosing the top and bottom of said volume;

means to develop a trapping field in said volume by applying voltages to said ring and to said end cap electrodes; said voltage being applied to said ring electrodes being a fixed RF frquency $W_0$;

means to modulate said RF frequency $W_0$ at a lower fixed frequency $W_2$ to induce CID;

means to apply a supplemental RF tickle field to said end caps, said supplemental tickle field frequency being at frequency $W_1$, said frequency $W_1$ being determined by the secular oscillation equation $W_1=\frac{1}{2}\beta_z W_0$, without any correction for space charge or non-linear electrode effects; and means to control energization sequence and time duration of excitation of said means to modulate said RF trapping field and said supplemental RF tickle field; and means, in operation, to cause said supplemental tickle field frequency to be energized during only a portion of time that said modulator of said RF trapping field is energized.

11. In the QIT of claim 10 wherein said means to modulate said RF frequency at a lower fixed frequency includes a summing circuit coupled to an error amplifier, wherein said summing circuit combines three signals and sends the sum of all three signals to said error amplifier.

12. The QIT of claim 11 wherein the means to modulate said RF frequency further includes means to couple a low frequency CID modulator signal to said summing circuit as one of said signals.

* * * * *